United States Patent [19]

Tabacheck

[11] 3,961,789

[45] June 8, 1976

[54] NET TIGHTENER

[76] Inventor: Martin S. Tabacheck, Box 514 Stoney Batter Road, Kingsville, Md. 21087

[22] Filed: Mar. 13, 1975

[21] Appl. No.: 557,938

[52] U.S. Cl. ..... 273/29 BE; 256/37

[51] Int. Cl.[2] ..... A63B 61/00

[58] Field of Search ..... 273/29 DC, 29 BE; 254/162, 163, 164, 78, 74–77, 79, 83; 256/37

[56] References Cited

UNITED STATES PATENTS

| | | | |
|---|---|---|---|
| 1,632,553 | 6/1927 | Lane | 273/29 BE |
| 1,768,615 | 7/1930 | Lane | 273/29 BE |

FOREIGN PATENTS OR APPLICATIONS

| | | | |
|---|---|---|---|
| 225,450 | 12/1924 | United Kingdom | 273/29 BE |
| 9,529 | 6/1889 | United Kingdom | 273/29 BE |

*Primary Examiner*—Richard C. Pinkham
*Assistant Examiner*—T. Brown
*Attorney, Agent, or Firm*—Sherman Levy

[57] ABSTRACT

A net tightener is provided that includes a member mounted on a vertically disposed post, and wherein a bracket has a pin for selectively engaging slots in a bar that is pivotally connected to the unit. The member includes a collar encircling a post and being fixed thereon; attached to the collar is a pair of horizontally extending, spaced apart arms having pivotally attached to their outer ends an elongated lever bar. The lever bar is provided with a plurality of slots along its lower edge. A substantially U-shaped yoke is provided for attachment between the end of a net holding cable and the lever bar. A hook element is provided at the bight portion of the U-shaped yoke for attaching the yoke to the cable and a pin is provided at the opposite end of the yoke for selectively attaching the yoke along the lever bar at the slots for varying the tension in the cable as the lever bar is pivoted on the arms.

1 Claim, 2 Drawing Figures

NET TIGHTENER

BACKGROUND OF THE INVENTION

1. Field of the Invention

The present invention relates to net tighteners, and more particularly to tighteners for tennis nets and the like. A manually movable bar is provided with a plurality of slots for selectively receiving a pin that is carried by a bracket or yoke so that the desired or proper amount of tension can be maintained on the cable that supports the tennis net.

2. Summary of the Invention

A tennis net tightener is provided that facilitates the stretching of the cable that supports the tennis net, and wherein the tightener, when adjusted properly, will remove all slack from the tennis net and wherein the device can be locked in position so that it can not be tampered with. Also, when using the device of the present invention when making an adjustment, the adjustment can be made with very little effort. In addition, the device is constructed so that corrosion will not have a tendency to make adjustment of the parts difficult. The device is constructed so that the adjustment is entirely in the slotted handle and is very simple to operate.

The primary object of the present invention is to provide a tennis net tightener that has improved characteristics and advantages for tightening a tennis net or other net such as the type used in sporting events or activities.

Still another object of the present invention is to provide a tennis net tightener that is ruggedly constructed and efficient to use and which is relatively simple and inexpensive to manufacture.

Other objects and advantages of the present invention will become apparent in the following specification when considered in the light of the attached drawings.

DESCRIPTION OF THE PREFERRED EMBODIMENT

Figures 1, 2:
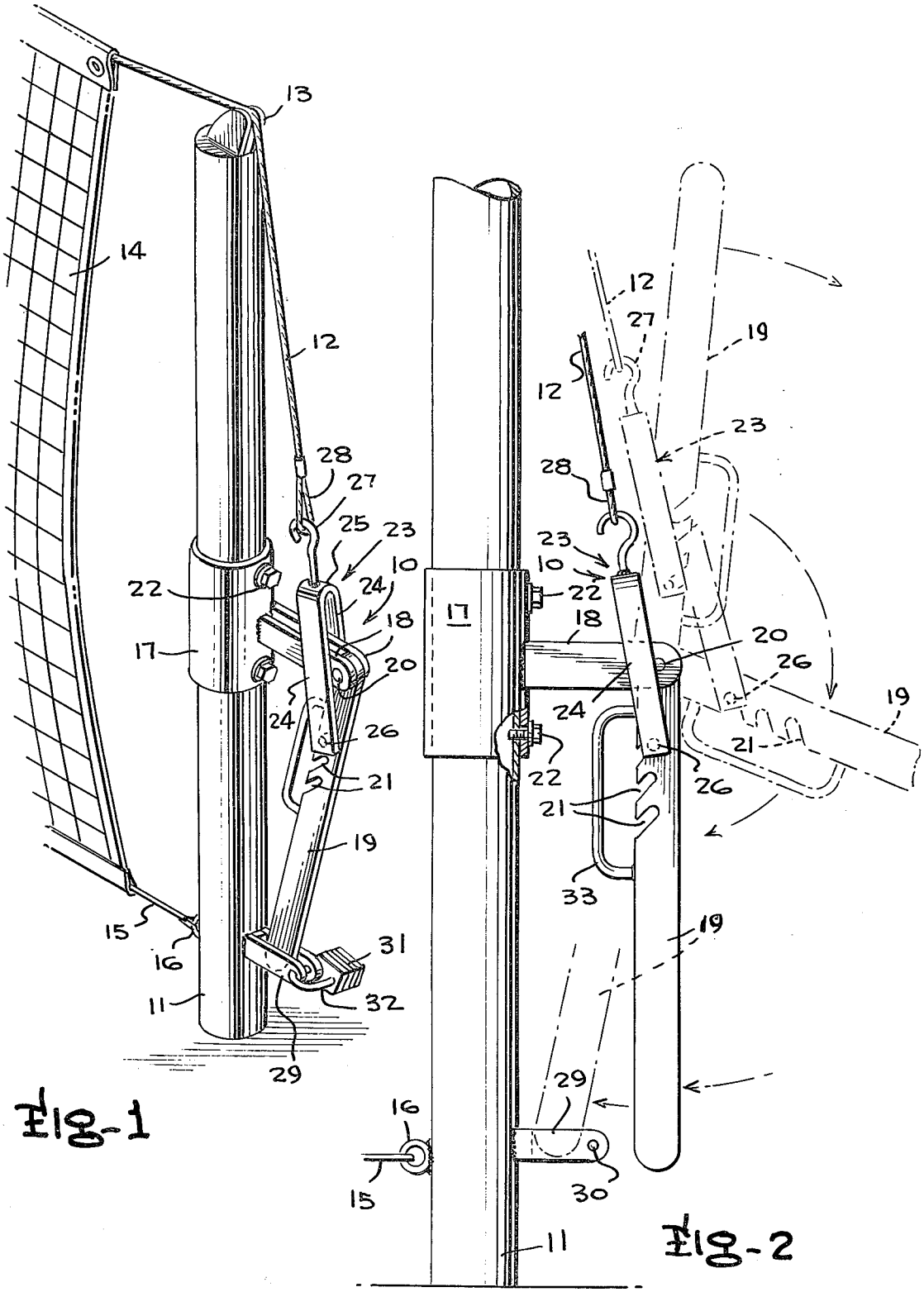
FIG. 1 is a perspective view illustrating the tennis net tightener of the present invention being used.
FIG. 2 is an elevational view showing the parts in a different position from that illustrated in FIG. 1.

Referring in detail to the drawings, the numeral 10 indicates the tennis net tightener of the present invention for use with a vertically disposed post 11. The numeral 12 indicates a net cable that engages a guide member 13 on the upper end of the post 11, FIG. 1, and the cable 12 is connected to the upper portion of a conventional tennis net 14. The numeral 15 indicates the usual cable that is connected to the lower end of the net 14, and the cable 15 is anchored in place as at 16.

As shown in the drawings, the net tightener 10 of the present invention includes a cylindrical collar 17 that is secured in place on the post 11 in any suitable manner, as for example by means of bolts such as the securing elements or screws 22.

A pair of spaced parallel support members or arms 18 are horizontally disposed, and the support members 18 may be secured as by welding to the collar 17. The numeral 19 indicates a bar or handle that is pivotally connected between the outer ends of the support members 18 as at 20, and the bar 19 is provided with a plurality of spaced apart slots 21. The slots 21 are arranged angularly with respect to the longitudinal axis of the bar 19.

A bracket or yoke 23 has a pin 26 connected thereto, and the pin 26 is adapted to selectively engage the slots 21 as shown in the drawings. The bracket 23 includes a pair of spaced parallel side portions 24 as well as a curved end portion 25. A hook member 27 is suitably affixed to the curved end portion 25, and the hook member 27 engages an end portion or bushing 28 on the end of the net cable 12.

The numeral 29 indicates a pair of spaced parallel body pieces or projections that are secured as by welding to the lower portion of the post 11, and the outer ends of the projections 29 are provided with registering apertures or openings 30 whereby the portion 32 of a conventional lock 31 can be arranged in engagement with the openings 30 in order to maintain the handle 19 locked in a position such as that shown in FIG. 1.

As shown in the drawings, a guard piece 33 may be connected to the handle 19 for helping to maintain the parts in their proper assembled position when initially shipping the units from one location to another. However, in actual practice, the guard units 33 can be omitted.

From the foregoing, it will be seen that there has been provided a net tightener which is especially suitable for use in tightening nets for tennis courts and the like. However, it is to be understood that the tightener of the present invention can be used for tightening other cables for supporting other members such as other nets and units that may be used.

In use, with the parts arranged as shown in the drawings, when using the device the collar 17 is suitably secured to the post 11, as for example, by means of the bolts or screws 22. Then, with the hook 27 arranged in engagement with the portion 28 of the cable 12, the bar 19 functions as a handle so that by pivoting the handle 19 to a desired location and with the pin 26 engaging the proper slots 21, the tension on the cable 12 can be maintained at the proper amount of tension. After the bar 19 has been positioned between the members 29, as shown in FIG. 1, a lock 31 can have its portion 32 arranged in engagement with the openings 30 whereby the cable 12 will be maintained under the proper tension and wherein slack will be eliminated from the cable 12 and net 14.

Similarly, when it is desired to release tension on the cable and net, it is only necessary to unlock the lock 31 and remove the same whereby the parts can move from the position shown in FIG. 1 to a position such as that shown in FIG. 2 whereby tension on the cable 12 will be released.

The parts can be made of any suitable material and in different shapes or sizes as desired or required.

When using the device, the pin 26 can be initially arranged in a slot such as the upper most slot 21. Then the handle 19 can be pulled down. If additional tension on the cable is required after this step, the parts can be returned to their initial position and the pin 26 can then be engaged with a different slot 21. It will be noted that the unit functions as an over-center locking mechanism due to the arrangement of the pivot points such as the pivot points 20 and 26 so that after the parts have been moved to their locked positions, any pressure that is exerted on the cable will have a tendency to lock the device in place rather than causing it to come unlocked.

The purpose of the net tightener of the present invention is to stretch the cable, such as the cable 12, that is secured to a cleat at one tennis post to the other tennis post to which the tightener is secured. The stretched cable carries the tennis net between both posts and must carry the net as parallel to the court's surface as possible. The tightener, when adjusted properly, will remove all slack from the tennis net and is locked in a position where it can not be tampered with. When making an adjustment, no effort is required. In addition, there are no parts that will likely get corroded to make adjustment difficult. The adjustment is entirely in the slotted handle and is very simple to operate. In previous tighteners, such previous tighteners after being exposed to the elements or weather for several years have a tendency to become corroded to make adjustment very difficult. Also, the prior devices have been made of cast material whereas the present invention is not made of such cast material.

Further, with the present invention there are no parts to ordinarily break or get worn out.

In the present invention, instead of making certain of the elements out of separate pieces that are welded together, the parts can be stamped out of a suitable metal. The pin 26 may be welded to the inner surfaces of the portions 24 of the yoke or bracket 23. When mounting the device, the post 11 and collar 17 can be drilled to receive the securing elements 22.

The present invention possesses certain important differences and advantages not found in the prior tighteners. For example, other tighteners are constructed of cast iron which will occassionally break under tension. Cast is extremely difficult and expensive to repair with no guarantee nor will it return to its original strength when repaired.

The tightener of the present invention contains no breakable parts which cannot be repaired if vandalized. However, if vandalized by means of hack sawing or bending, the tightener can always be repaired to its original strength and durability inexpensively.

The location 20 on the drawing is preferably plug welded and ground smoothly on both sides thereby eliminating any exposed bolt heads which can be hack sawed or ground off. This method of securement at 20 is tamper proof.

The slots in the member 19 are so arranged as to prevent anyone from removing the pin 20 when the tightener is in a closed position under full tension.

In addition, it is to be emphasized that the great degree of corrosion that accumulates on other types of tighteners and the extreme difficulty in the adjustment of the mechanism after several years of exposure to the elements is overcome by this invention.

Although the invention has been illustrated and described with reference to the preferred embodiments thereof, we wish to have it understood that it is in no way limited to the details of such embodiments, but is capable of numerous modifications within the scope of the appended claims.

What is claimed is:

1. In a tennis net support means having at least one cable for supporting a net on a vertically disposed post having cable guide means for receiving one end portion of the cable, said cable having a hook receiving member at one end, the improvement comprising a collar encircling said post and fixed to said post by securing elements, said securing elements being at least one screw member, said screw member engaging aligned holes in said collar and said post, a pair of support members extending outwardly from said collar and substantially perpendicular to said post, an elongated lever bar swingably connected at one end to the outer ends of said support members, said lever bar having a plurality of downwardly facing and spaced apart slots located adjacent to said one end, each of said slots being inclined from one edge of said bar toward said one end, a guard member having a portion spaced from said slots and having opposite ends connected to said lever bar so that said guard member straddles said slots, a yoke having elongated generally parallel spaced apart side portions connected together at one end by a bight portion, said side portions being spaced apart a distance to receive said support members, pin means connecting the ends of said side portions remote from said bight portion, said pin means being confined within the area between said guard member and said lever bar and selectively received within said slots, hook means carried by said yoke at said bight portion and engageable with the hook receiving member of said cable, projection means secured adjacent to the lower end of said post and extending substantially perpendicular thereto and in spaced parallel relationship with said support members, means for locking the other end of said lever bar to said projection means when said yoke overlies said support members and is positioned inwardly of said one end of said lever bar, whereby said lever bar is swung upwardly so that said hook means is attached to said hook receiving member and then is swung downwardly so that said yoke overlies said support members and the tension of the cable urges said lever bar toward said post.

* * * * *